US007726615B2

(12) United States Patent
Rutz

(10) Patent No.: US 7,726,615 B2
(45) Date of Patent: Jun. 1, 2010

(54) SHELF SYSTEM

(75) Inventor: Josef Rutz, Rosenheim (DE)

(73) Assignee: Steelcase Werndl AG, Rosenheim (DE)

( * ) Notice: Subject to any disclaimer, the term of this patent is extended or adjusted under 35 U.S.C. 154(b) by 290 days.

(21) Appl. No.: 11/885,448

(22) PCT Filed: Feb. 16, 2006

(86) PCT No.: PCT/EP2006/001417

§ 371 (c)(1),
(2), (4) Date: Nov. 29, 2007

(87) PCT Pub. No.: WO2006/094611

PCT Pub. Date: Sep. 14, 2006

(65) Prior Publication Data

US 2008/0156950 A1 Jul. 3, 2008

(30) Foreign Application Priority Data

Mar. 4, 2005 (DE) ..... 10 2005 010 026
Aug. 4, 2005 (DE) ..... 10 2005 036 809

(51) Int. Cl.
*A47G 29/02* (2006.01)

(52) U.S. Cl. ..... 248/250; 248/235; 248/239; 248/240; 248/240.4; 108/147.11; 108/147.17; 312/408

(58) Field of Classification Search ..... 248/235, 248/239, 240, 240.4, 250; 108/106–108, 108/147.11, 147.17; 312/408
See application file for complete search history.

(56) References Cited

U.S. PATENT DOCUMENTS 813,501 A * 2/1906 Keil ..... 248/243
1,702,937 A * 2/1929 Friedemann ..... 248/243
3,207,100 A 9/1965 Peacock
3,580,535 A * 5/1971 Naske ..... 248/239
3,835,794 A 9/1974 Wassberg et al.
4,568,050 A * 2/1986 Radoy et al. ..... 248/223.41
4,720,069 A * 1/1988 Bessinger ..... 248/250

(Continued)

FOREIGN PATENT DOCUMENTS

DE 25 22 393 12/1976

(Continued)

OTHER PUBLICATIONS

International Search Report for PCT/EP2006/001417 mailed Apr. 28, 2006.

*Primary Examiner*—Alfred J Wujciak, III
*Assistant Examiner*—Michael McDuffie
(74) *Attorney, Agent, or Firm*—Nixon & Vanderhye PC

(57) ABSTRACT

Disclosed is an improved shelf system which is characterized by the following features: an anchoring pot is provided which can be inserted in a fixed and captive manner into a corresponding bore of a shelf bottom, said bore facing the shelf bottom support; a slot opening and a screw path for a locking screw, which is offset relative thereto and runs diagonally, are provided in the anchoring pot; a portion of an anchoring section that is part of the shelf bottom support can be inserted into the slot; and the locking screw can be twisted in such a way that the shelf bottom support is directly or indirectly fixed at least in a non-positive and preferably a positive fashion.

21 Claims, 8 Drawing Sheets

U.S. PATENT DOCUMENTS

Figure 1:
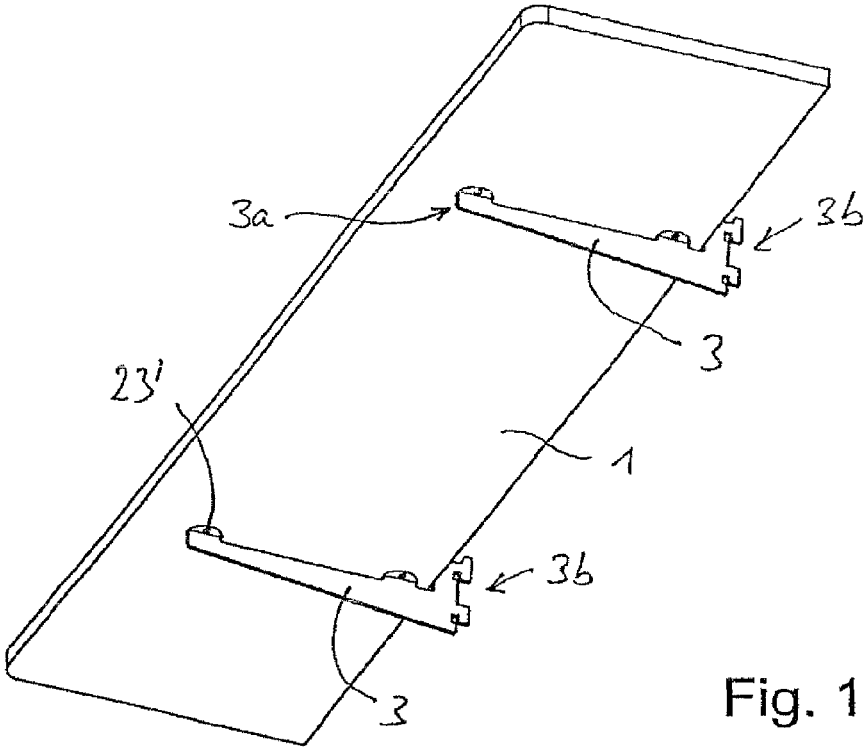

| | | | | | |
|---|---|---|---|---|---|
| 4,736,919 | A | * | 4/1988 | Bessinger | 248/250 |
| 4,738,426 | A | * | 4/1988 | Bessinger | 248/250 |
| 4,762,081 | A | * | 8/1988 | Porter | 114/364 |
| 4,854,534 | A | * | 8/1989 | Porter | 248/222.14 |
| 4,895,331 | A | * | 1/1990 | Nehls | 248/245 |
| 4,948,207 | A | * | 8/1990 | Rolls et al. | 312/306 |
| 5,271,591 | A | * | 12/1993 | Pittella | 248/250 |
| 5,297,486 | A | | 3/1994 | Herrmann et al. | |
| 5,326,061 | A | * | 7/1994 | Hamilton | 248/239 |
| 5,692,817 | A | * | 12/1997 | Jun et al. | 312/408 |
| 6,098,566 | A | * | 8/2000 | Metcalf | 114/362 |
| 6,138,584 | A | * | 10/2000 | Waite | 108/108 |
| 6,402,108 | B1 | * | 6/2002 | Remmers | 248/243 |
| 6,691,964 | B1 | * | 2/2004 | Schaefer | 248/250 |
| 6,986,488 | B2 | * | 1/2006 | Migli | 248/250 |
| 7,055,788 | B2 | * | 6/2006 | Migli | 248/239 |
| 2003/0233965 | A1 | | 12/2003 | Brazier | |

FOREIGN PATENT DOCUMENTS

| | | |
|---|---|---|
| DE | 37 10898 | 2/1988 |
| GB | 1 547 627 | 6/1979 |

* cited by examiner

SHELF SYSTEM

This application is the US national phase of international application PCT/EP2006/001417 filed 16 Feb. 2006, which designated the U.S. and claims the benefit of German Application Nos. 10 2005 010 026.0 filed 4 Mar. 2005, and 10 2005 036 809.3 filed 4 Aug. 2005, each of which is incorporated herein by reference in its entirety.

The invention relates to a shelf system according to the preamble of Claim 1.

The most varied shelf systems using one or more shelf bottoms are known.

A known shelf system as a basic principle works with shelf supports, which are normally provided on their rear ends with at least two hanging lugs, lying offset to one another in the vertical direction, which can be hung in vertically running shelf rails, fixed for example on the wall or on vertical props or supports. For this purpose, these shelf rails comprise elongated holes lying offset in the longitudinal direction of the shelf rail, into which the corresponding lugs of the shelf supports can be hung.

The shelf supports therefore project transversely away from the shelf rail. They can have a horizontal top support edge, on which a shelf bottom can be laid.

In order to anchor the shelf bottom as securely as possible, that is to say, particularly also against inadvertent raising, and therefore to prevent it from lifting from the shelf support, shelf supports are known, which are provided with horizontally extending lugs curved about 90°, into which a hole is drilled. As a result, screws can be inserted from the lower face into a shelf bottom.

The object of the present invention is to create, in comparison to the above, an improved and aesthetically more pleasing shelf system, with which a shelf bottom, as easy to detach and nevertheless as securely as possible, can be fitted to a shelf support.

The object is achieved according to the invention through the features indicated in Claim 1. Advantageous embodiments of the invention are indicated in the sub-claims.

In the case of the present system according to the invention, an aesthetically very pleasing solution is achieved, which also ensures firm and secure anchoring of a shelf bottom on corresponding shelf supports. Nevertheless, the shelf bottoms can be easily dismantled and removed again by in turn loosening a screw, in particular a grub screw.

The system according to the invention substantially only requires anchoring pots, for example in the form of insertable pots, which can be hammered or inserted into corresponding bores on the lower face or mounting side of a shelf bottom. For this purpose, a corresponding pocket bore, in which the corresponding anchoring pot can be anchored, is inserted in the shelf bottom on the mounting side, that is to say, normally on the lower face. The anchoring pots have a Christmas tree or saw tooth profile on the outer circumference, as a result of which they are firmly prevented from being pulled out of the pocket bore by interaction with the wall of the bore.

Now, an insertion opening, preferably a slot-type insertion opening, and an opening offset thereto for twisting a screw, in particular a grub screw, in and out, are provided on the lower shelf bottom face. A corresponding projection, protruding upwards from the shelf support, preferably in the form of a lug, can be inserted into the anchoring pot through the corresponding insertion opening until the shelf bottom rests on the shelf support.

Said screw can either interact directly, thus generally collide, with the shelf support or the preferably lug-type projection, which is provided on the shelf support, and/or prevent the anchoring projection from being pulled off, by for example, a non-positive or positive connection being formed, or, however, it is possible that said screw interacts accordingly only indirectly with the shelf support or with the preferably lug-type projection, if the screw firstly acts on a force reversing mechanism, which then produces the corresponding positive or non-positive locking while interacting with the shelf support and/or the lug formed thereon.

This force reversing mechanism can be constructed in accordance with a variant, so that forces working in the axial direction or predominantly axial direction, produced by twisting the screw (even if the adjustment path of the screw runs parallel to the projection on the shelf support) are reversed by said force reversing mechanism with a component transverse to the anchoring projection, preferably configured in lug form, of the shelf support, and as a result at least non-positive locking between the anchoring pot and the shelf support is produced. Said force reversing mechanism preferably consists of a ball, in particular a steel ball, wherein the advancing section of the screw strikes the ball off-center, so that the ball can be moved in an adjustment or ball channel towards the anchoring projection, preferably in the form of a lug.

If, as stated, the screw, however, does not interact via the force reversing mechanism but directly with the shelf support or the lug formed thereon, it is preferably intended that the adjustment or screw path of said screw runs diagonally and at the same time the axial direction of this adjustment path intersects the preferably lug-type projection of the shelf support protruding into the anchoring pot. As a result, the screw can be twisted and tightened, so that the advancing screw face collides directly with the lug-type projection of the shelf support, thus producing the desired non-positive and/or positive engagement with the shelf support or the lug belonging to the shelf support.

In a particularly preferred embodiment a recess or passage, for example in the form of a circular bore whose smallest diameter is less than the diameter of the ball, is provided in the anchoring projection, preferably in the form of a lug, of the shelf support. As a result, the ball can engage with a partial depth into this recess in the anchoring projection or the lug in fixed position and therefore not only leads to non-positive but in particular to positive locking, as a result of which a shelf board is securely held on the associated shelf support.

If said screw is to interact directly with the shelf support or the lug, the connection technique can be improved not only for achieving non-positive but, above all, for achieving positive connection, due to the fact that the advancing screw face now partly penetrates or engages into said recess or opening in the lug and, as a result, produces the desired positive engagement.

However, alternatively or additionally a projection, which engages into said recess or depression in the lug or generally in the anchoring projection of the shelf support, can also be formed in the anchoring pot itself, so that, in this case, when the force reversing mechanism, preferably in the form of the ball, is used, it only needs to rest non-positively against the anchoring projection outside the bore, in order to prevent the shelf bottom from lifting off the shelf support. Particularly in this case, a correspondingly broadly dimensioned holding space or a holding space conically widened in the insertion direction of the anchoring projection of the shelf support is provided in order to firstly insert, and subsequently tilt, the anchoring projection past the projection protruding laterally into the holding space, in such a manner that the corresponding projection connected to the holding pot engages into said bore in the preferably lug-type anchoring projection. The same system with a projection belonging to the anchoring pot, which engages into corresponding recesses in the lug belonging to the shelf support, can also be used in the case of a diagonally running screw, whose screw head directly interacts (that is to say, without force reversing mechanism) with the lug belonging to the shelf support.

Figure 7:
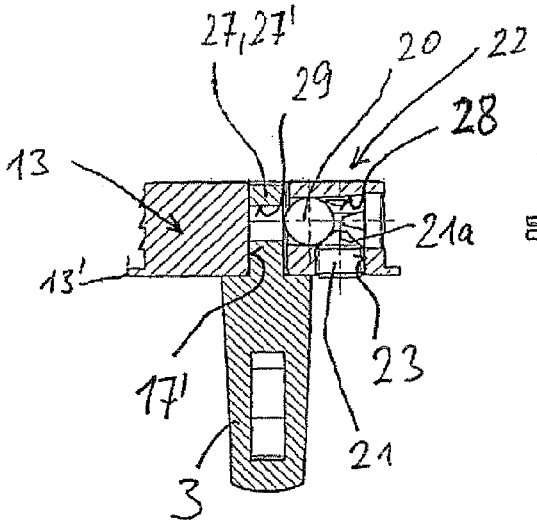
Figure 8:
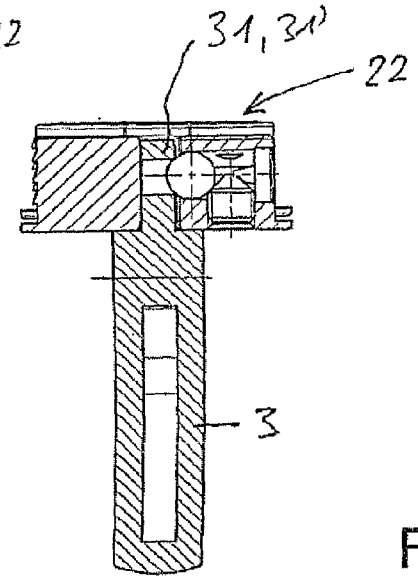
Figure 2:
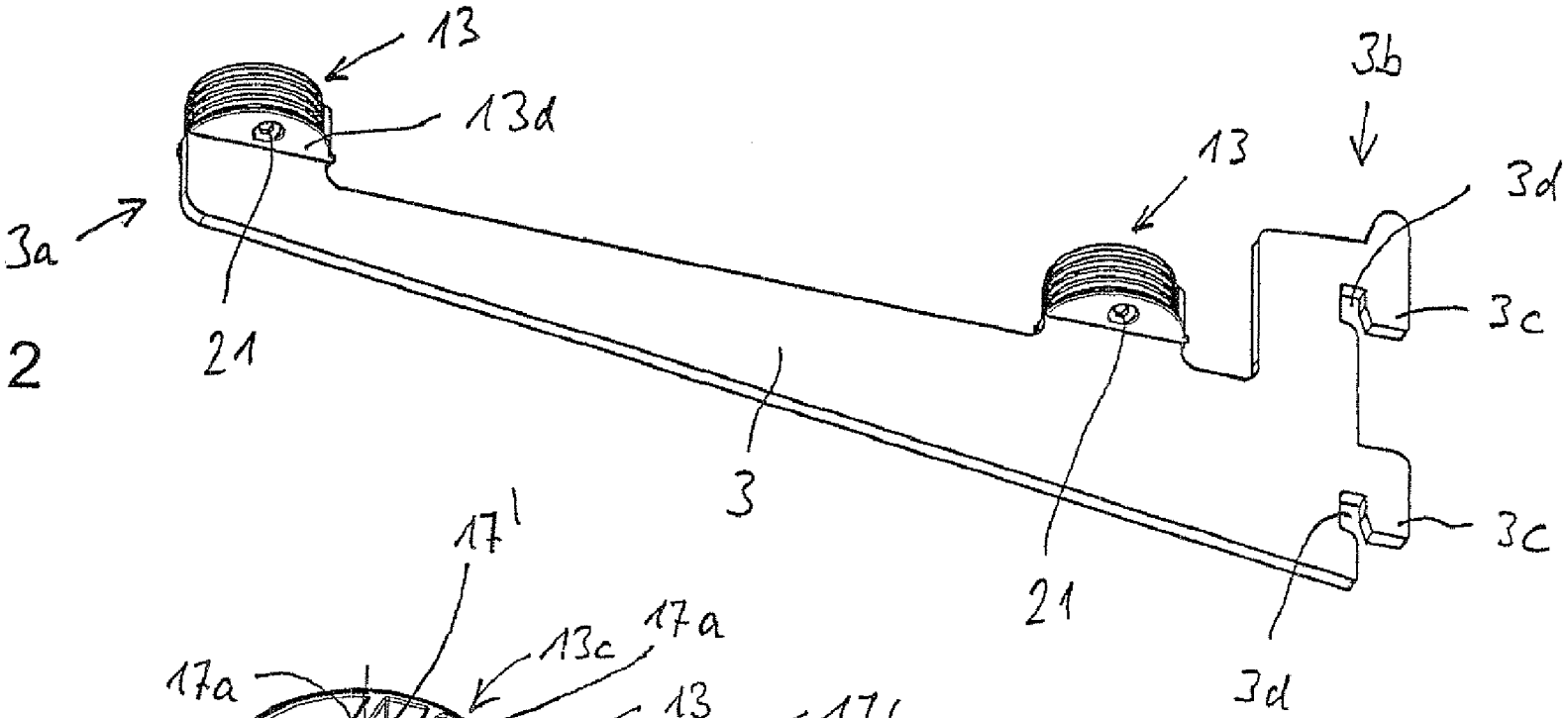
Figure 6:
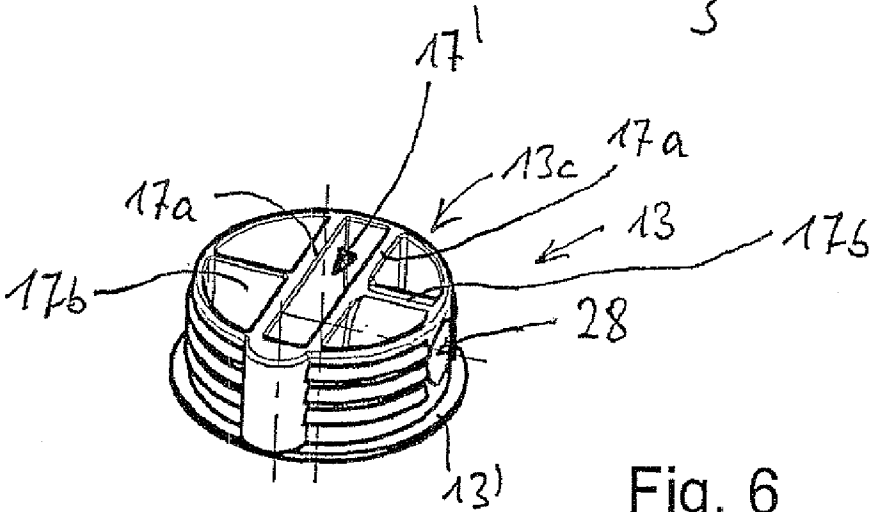
Figure 3:
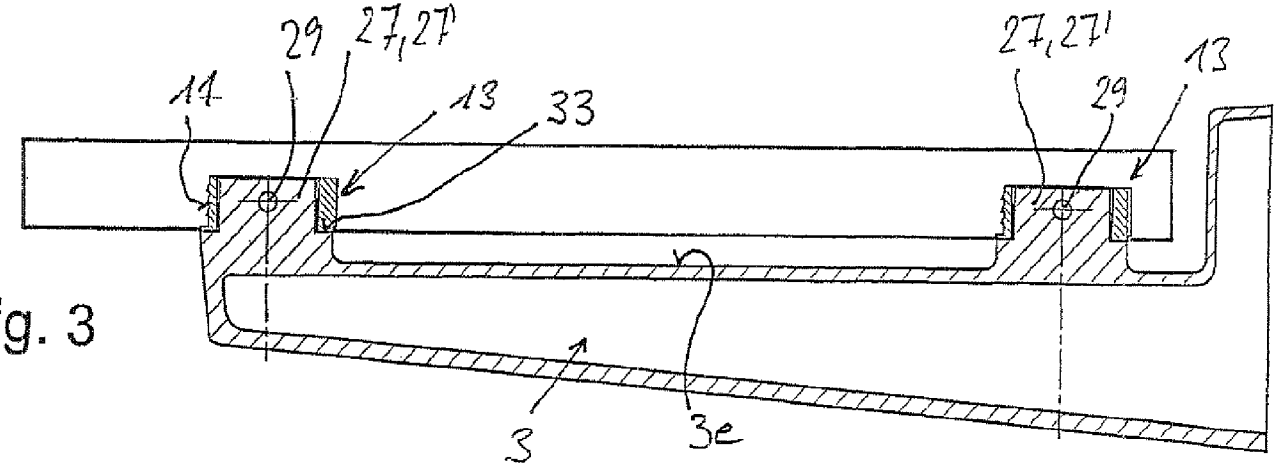
Figure 5:
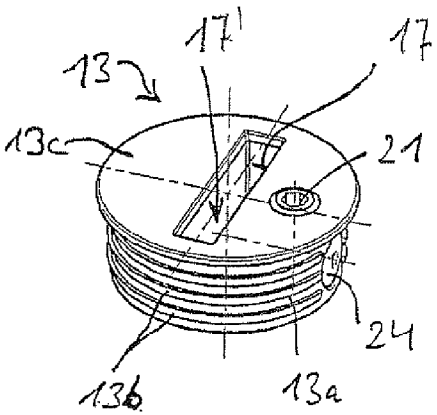
Figure 4:
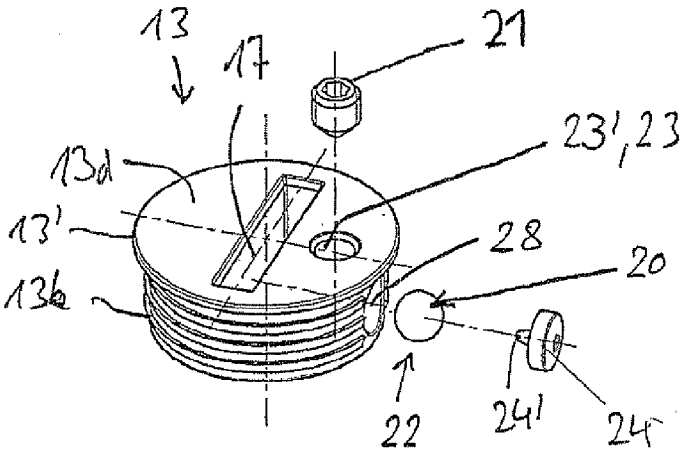
Figure 9:
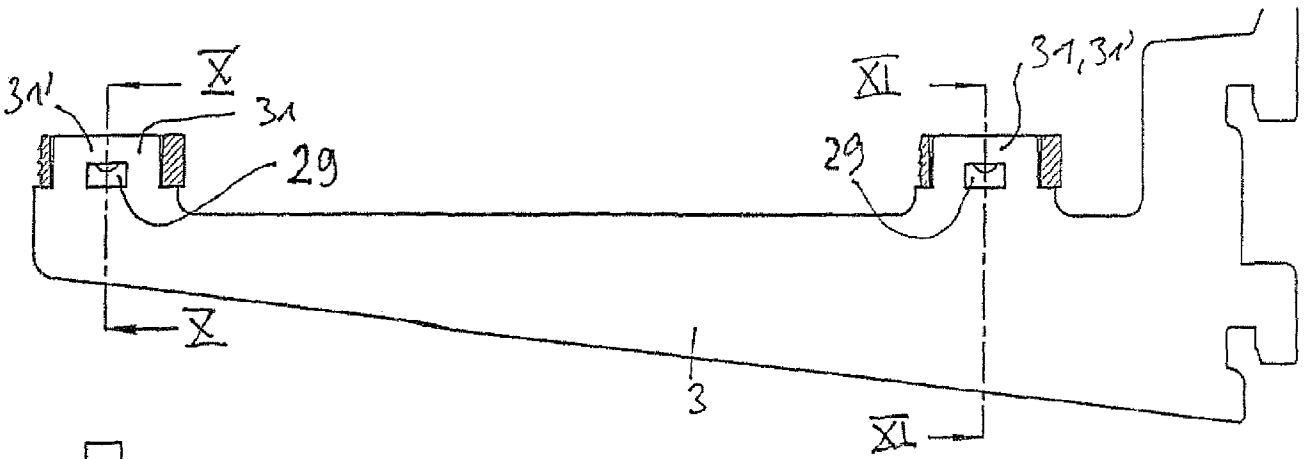
Figure 10:
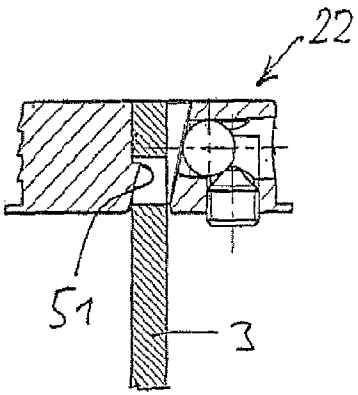
Figure 11:
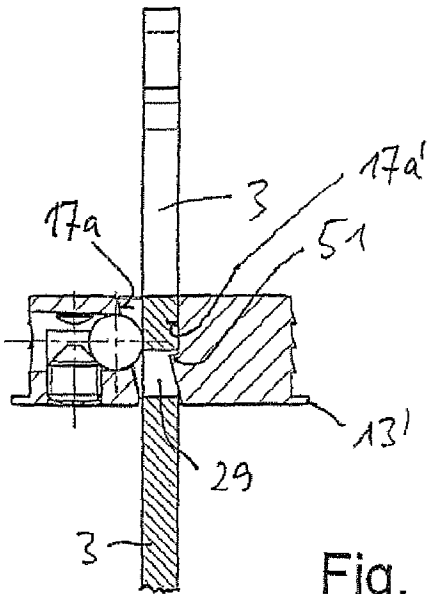
Figure 12A:
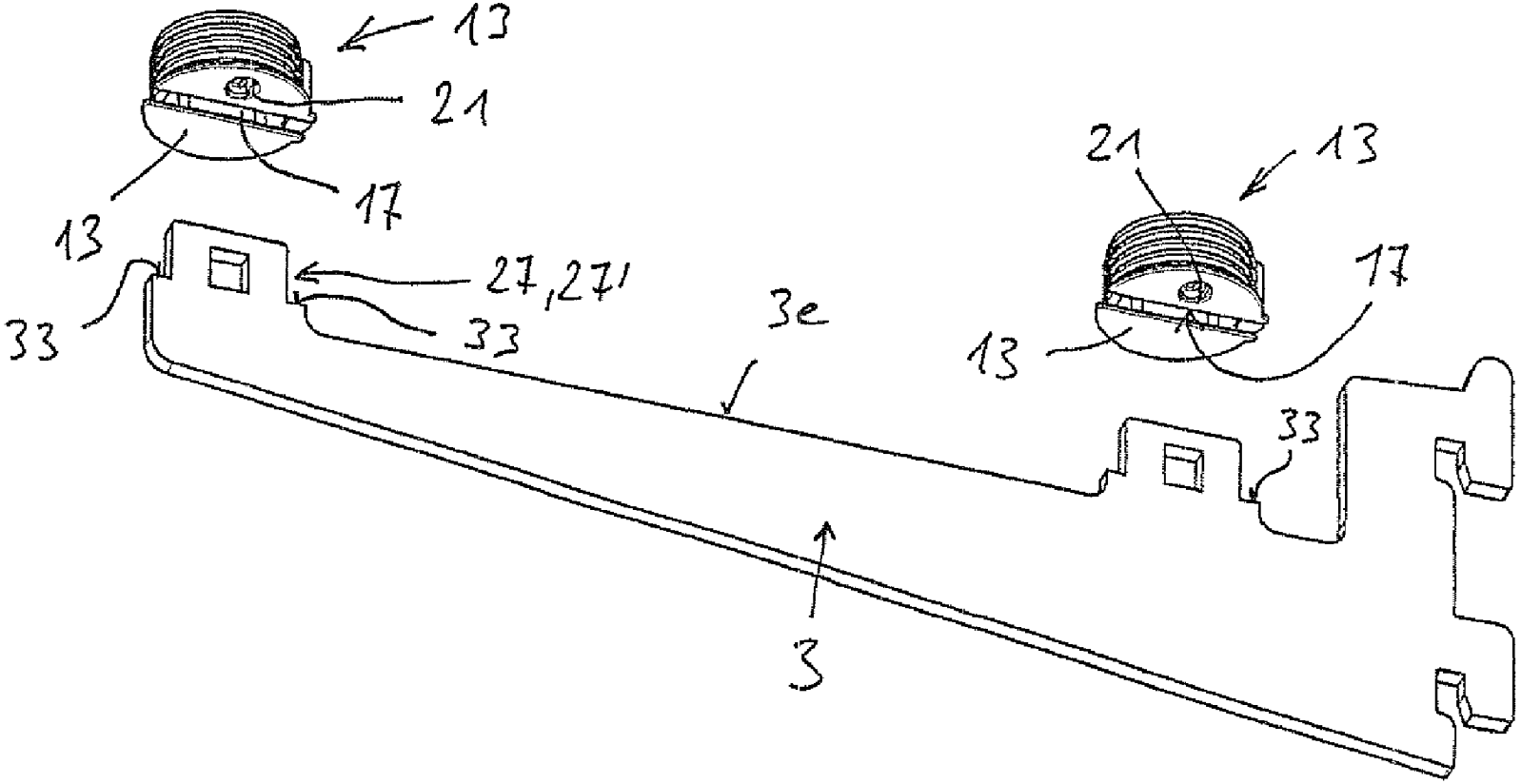
Figure 12B:
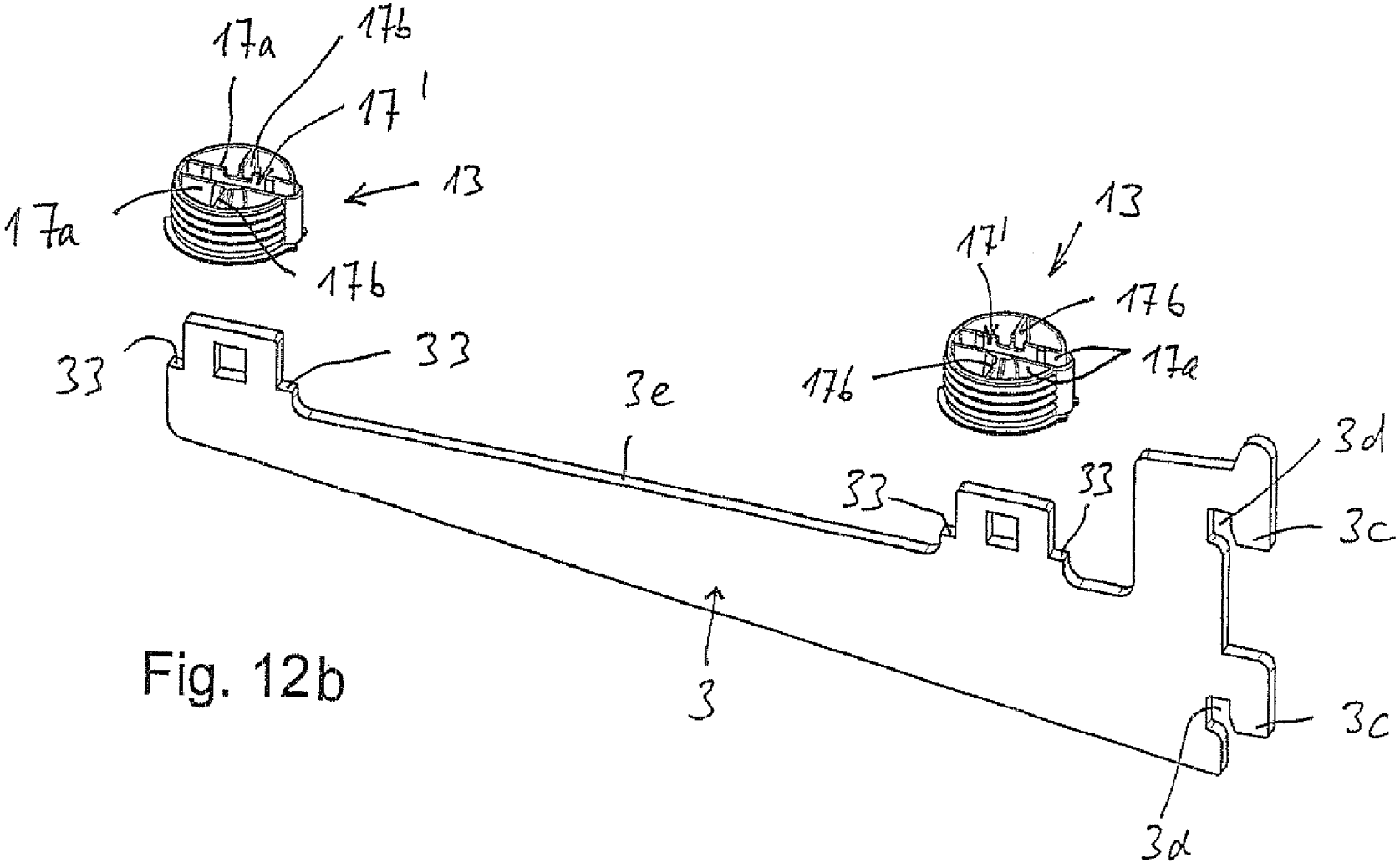
Figure 13:
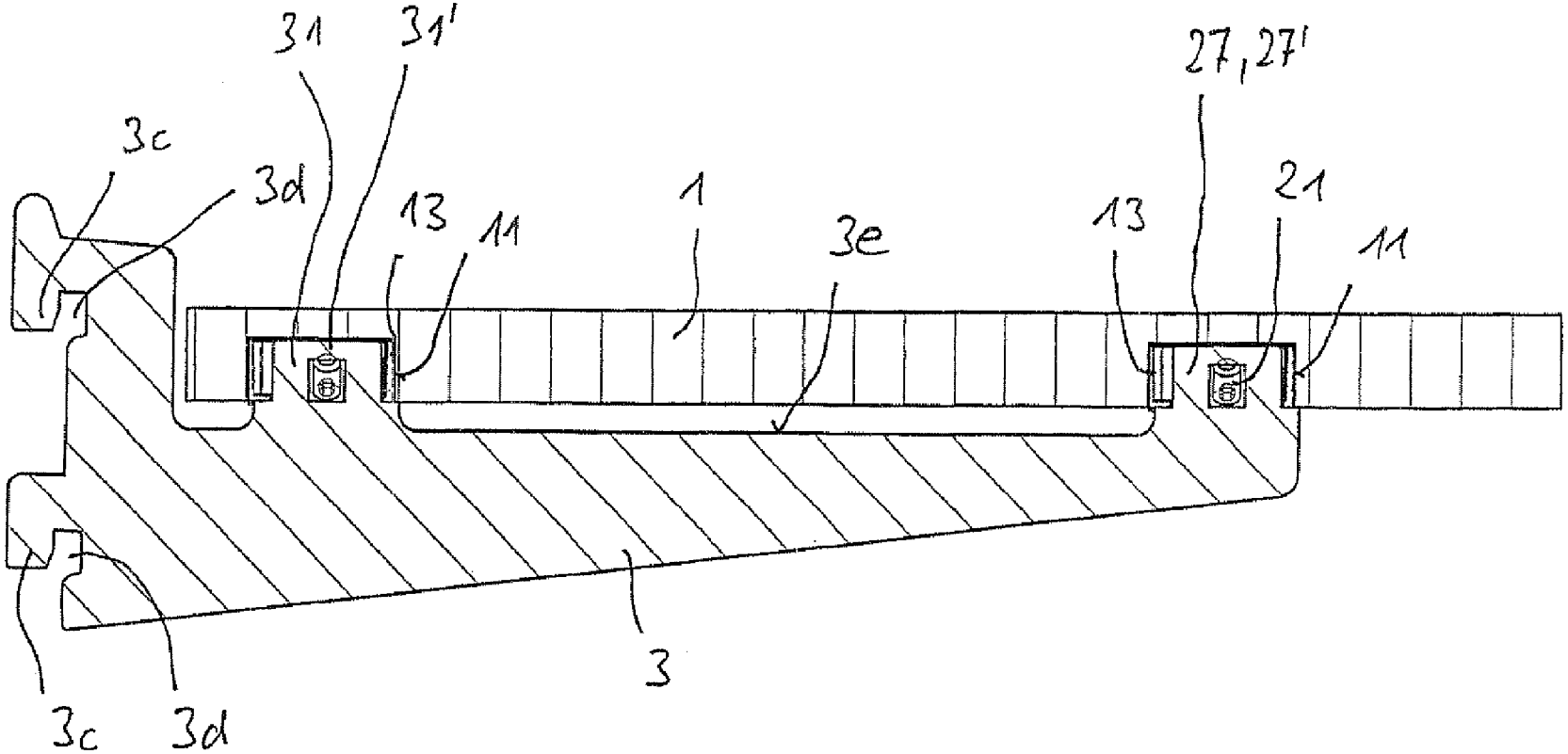
Figure 14:
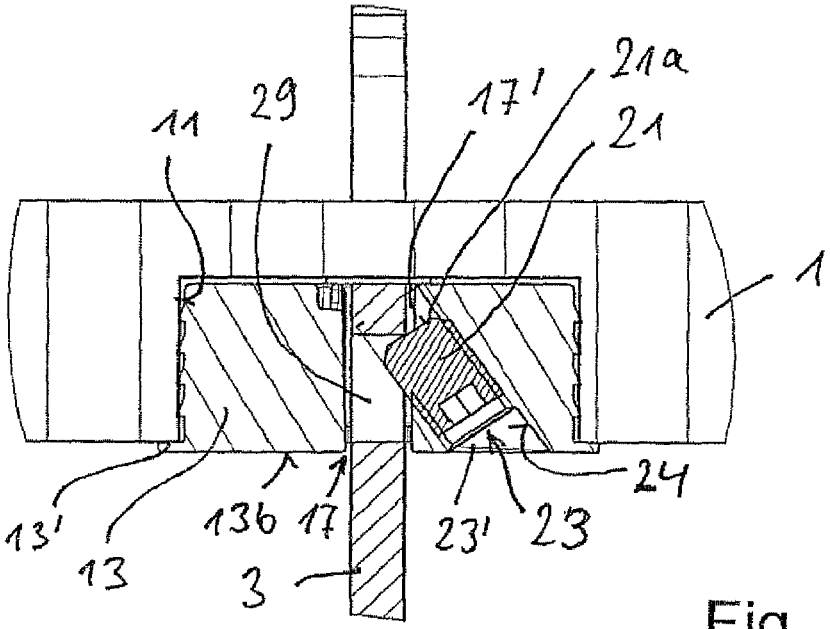

Further advantages, details and features of the invention will become evident from the following exemplary embodiments explained on the basis of drawings. These show in detail:

FIG. 1: a schematic perspective underneath view of a shelf bottom, which rests on two shelf supports;

FIG. 2: a corresponding perspective illustration of the parts required for anchoring the shelf bottom;

FIG. 3 a schematic profile illustration through a shelf bottom with mounted anchoring pots and a shelf board;

FIG. 4: a perspective illustration of an anchoring pot according to the invention with associated parts;

FIG. 5: an illustration corresponding to FIG. 4 with a mounted anchoring pot;

FIG. 6: a perspective underneath view through the anchoring pot shown in FIG. 5;

FIG. 7 a cross sectional illustration through the anchoring pot in mounted condition on the shelf support in proximity to the free end of the shelf support before being fixed to a shelf support;

FIG. 8 a corresponding cross sectional illustration through the anchoring pot, as it is mounted on the further anchoring lug of the shelf support, in the already fixed condition;

FIG. 9: a schematic side view through a modified exemplary embodiment of an anchoring pot in sectional view in mounted condition on a shelf support (illustrated without shelf board);

FIG. 10: a cross sectional illustration along line X-X in FIG. 9;

FIG. 11: a corresponding cross sectional illustration along line XI-XI in FIG. 9; and FIG. 12*a*: an illustration corresponding to FIG. 2 with anchoring pots shown separately and the necessary shelf support;

FIG. 12*b*: an illustration corresponding to FIG. 12*a*, however in plan view rather than underneath view;

FIG. 13: a vertical profile illustration through one of the two shelf supports shown in FIG. 1 and the associated shelf bottom; and FIG. 14: a cross sectional illustration along line V-V in Fig.

In FIG. 1 a shelf bottom 1 is shown in schematic underneath view. Two shelf bottom supports 3 can be recognized lying offset in the longitudinal direction of the shelf bottom. From the magnified illustrations in FIGS. 2 and 3 it can be seen that such a shelf bottom support 3 usually has a so-called anchoring section 3*b* on its end opposite the free support arm end 3*a*. This anchoring section in the exemplary embodiment shown has two anchoring lugs 3*c*, lying offset to one another in the vertical direction, which extend downwards over a certain vertical height and are formed by an adjacent hanging slot 3*d* in the configuration shown.

Such shelf bottom supports are known in principle. They can be hung into corresponding variously shaped support rails, usually running vertically on a wall or other support devices, which have elongated holes lying offset to one another in the vertical direction at a distance from the hanging lugs 3*c*. For anchoring such a shelf support 3 its anchoring end 3*b* is fitted in the known way onto the anchoring rail, not shown in more detail in the figures, wherein the anchoring lugs 3*c* extend into the slots formed in the anchoring rail, in order then to subsequently move the shelf bottom support downwards corresponding to the length of said hanging slots 3*d* and to secure it firmly to the shelf rail.

Said shelf bottom 1 is then to be mounted and detachably fixed on such a shelf support. To do this, for each shelf bottom 3 two bores 11, lying offset to one another in the longitudinal direction, that is to say pocket bores 11, are formed in the shelf bottom shown in the exemplary embodiment, as this can also be seen in principle from the cross sectional illustration in FIGS. 6 and 7.

So-called anchoring or insertion pots 13 are then hammered and firmly anchored into this pocket bore 11. So that these are held captively in the pocket bore 11, the outside diameter of the anchoring pots corresponds to, or is slightly larger than, the diameter of the pocket bore 11. Furthermore, the anchoring pots 13 are usually provided with Christmas tree or saw tooth like grooves 13*b*, circulating around the cross section on their circumferential pot wall 13*a* (FIGS. 4 and 5), which possibly can be even designed in thread form as continuous corrugations. After these pots are hammered in, they cannot be pulled out of the bore 11 again. These pots, for example, can be made of metal, in particular die-cast metal, such as for example die-cast aluminum, die-cast zinc etc. Likewise, however, these pots can also be made of plastic.

From the perspective illustration in FIG. 6, the interior view of the pots 13 can be seen, from which it is clear that the anchoring pot 13 is designed as a hollow part on the inside and has a rectangular opening slot 17 on the cap underside 13*c*, which in the exemplary embodiment shown changes into a holding space 17' interspersing the anchoring pot 13. This holding space 17' is limited by two lateral parallel walls 17*a*, which are again reinforced by means of two retaining walls 17*b* running perpendicularly thereto.

Furthermore, a fixing screw 21, preferably a grub screw 21, is provided in the anchoring pot 13, which can be twisted in or out of an adjustment, thread or screw path 23 running parallel to the holding space 17' in the material of the anchoring pot 13. This screw path 23 is formed by a hole or a corresponding channel 23 in the material of the anchoring pot 13.

The screw path 23 is arranged in such a way that the access opening 23' of the screw path 23 lies on the cap underside 13*c*, laterally offset to the opening slot 17. On the other hand, the screw or thread path 23 is aligned and arranged so that it cuts an adjustment path 28, in which, in the exemplary embodiment shown, a ball 20 is located. As a result, a force reversing mechanism 22 is created, the significance of which will be discussed in detail below.

The shelf bottom support 3 on its upper retaining or mounting side has two projections 27 lying offset in the longitudinal direction, which in the exemplary embodiment shown are configured as anchoring lugs 27'. In other words, the anchoring lugs 27' viewed laterally are shaped in a tongue or more rectangular fashion and connected solidly, that is to say, integrally, to the shelf bottom support 3. Therefore, they are part of the shelf bottom support 3. The shelf bottom support 3 formed in this way can be produced overall as a metal pressing and then painted for example.

Preferably, the anchoring lug 27' is provided in the exemplary embodiment shown with a likewise round anchoring opening 29, which intersperses the anchoring lug 27' while forming a circumferential material edge 31.

Said anchoring projection 27 and anchoring lug 27' rise above a horizontal support 33, shown in the exemplary embodiment, in the form of a horizontal support edge, whose longitudinal extension towards the shelf bottom support is greater than the length of the opening slot 17. In the exemplary embodiment shown, this has a length, which corresponds to the diameter of the anchoring bottom 13. Deviating therefrom, this edge, however, could also be constructed shorter and longer.

For anchoring a shelf bottom, the latter with the anchoring pots 13 firmly inserted in the pocket bore 11 is now placed onto the corresponding shelf bottom supports 3. For this purpose, said anchoring lugs 27' penetrate through the opening slots 17, correspondingly adapted to the form and size of the anchoring lugs 27', into the anchoring pot and as a result come to lie in the holding space 17' lying below the opening slot 17', which in the exemplary embodiment shown corresponds in its cross sectional dimension to the opening slot 17.

The penetration movement can continue until the advancing end of the anchoring lug 27' strikes the inner end of the anchoring pot 13 at the base of the pocket bore 11 and/or until the corresponding horizontal support edge 33, adjacent to the anchoring lug 27' strikes the anchoring pot lower face 13*b*. This support edge 33, in the exemplary embodiment shown, rises above an adjacent edge 3*e* of the shelf bottom support 3, the consequence of which is a virtually "floating" impression of the shelf bottom 1 above the shelf bottom support 3.

This mounting is carried out while the grub screw 21 is at least partially loosened. Now, the grub screw 21 is further tightened.

FIG. 7 reproduces the starting position before the grub screw 21 is tightened. Now, when the grub screw 21 is tightened, the screw face 21*a*, which is truncated in the exemplary embodiment shown, increasingly penetrates into the radial adjustment path 28, in which the ball 20 is located. Since the screw path 23 is arranged off-center, related to the mid-point of the ball on the side lying opposite the holding space 17', in which the anchoring lug 27' is introduced, as a result the ball or roller body 20 is moved transversely or radially in its associated adjustment path 28 towards the holding space 17' and thus towards the anchoring lug 27'. In other words, an axial force, which is produced by tightening the grub screw, is turned into a force running cross-wise thereto or, in the exemplary embodiment shown, even running perpendicularly to the lug 27', with which the ball 20 presses on the lug 27'. As a result, a force reversing mechanism 22 is thus created.

In the exemplary embodiment shown, said anchoring opening 29 is formed in the lug 27', in the exemplary embodiment shown in the form of a circular hole (however, it can also have a different, for example, polygonal or rectangular etc., cross section). The diameter of such an opening, in the case of a non-circular opening the smallest diameter in one direction, is, however, less than the diameter of the ball, so that the ball can only penetrate with a partial depth into the opening, thus in an order of magnitude smaller than the radius. The ball with a ring seat then contacts the edge of the anchoring opening 29, whereby a positive connection is formed. In this position, the shelf bottom can no longer be lifted off the shelf support.

In particular from FIGS. 7 and 8, it is also evident that the adjustment path 28 for the ball, formed in the anchoring pot 13 transverse to the adjustment path of the grub screw 21, is outwardly sealed by a plug 24. As a result, depending on the production process, the ball can be introduced into the adjustment path and then the adjustment path can be sealed by fitting the plug 24. Since the holding opening on the opposite side of the adjustment path is narrower than the outer diameter of the ball, this cannot fall out through the holding space 17'.

Finally, it is also clear from the drawings, in particular FIGS. 4, 7 and 8 that the inside of the plug 24 is provided with a projection or elevation 24', such that the ball or its mid-point can always come to lie only on one side, related to the axial direction of the grub screw, in such a manner that the grub screw with its advancing face 21*a* can only displace the ball when twisted towards holding space 17' and not in the opposite direction.

Preferably, a ball made of hard material, in particular a steel ball, is used for the ball or roller body.

In the exemplary embodiment shown, a positive connection is thus formed, wherein the ball at least partly intersperses the anchoring opening 29 or penetrates into it and collides with the upper transverse hoop 31' of the material section 31 surrounding the anchoring opening 29.

The projection 27, preferably formed as anchoring lug 27', in principle can also have different configurations. Thus, in particular the anchoring opening 29 does not need to intersperse the anchoring lug 27' completely. A recess, into which the ball 20 can engage or penetrate, would be sufficient in many cases. Likewise, the lug, viewed laterally, does not need to be rectangular or tongue-shaped, but can also be formed more pin-shaped etc.

From the construction described, it is evident that the anchoring pots 13 with their elongated slot-shaped opening 17, in the exemplary embodiment shown adapted accordingly to the lug form, as well as the associated holding space 17' are anchored in the shelf bottom, in such a way that the longitudinal direction of the slot 17 is aligned with the longitudinal direction of the anchoring lug 27' and thus the longitudinal direction of the shelf bottom support 3. Therefore, said grub screw and the associated adjustment path 23 are also provided with an offset transverse thereto, as is evident from the figures. In the exemplary embodiment shown, the adjustment path 23 is arranged running parallel to the holding space 17', that is to say, perpendicularly to the bottom face 13*d* of the anchoring pot 13, which visibly comes to lie on the lower side of a shelf board.

From the exemplary embodiment, it is clear that the anchoring pot 13 preferably has a circumferential edge 13' limiting the hammering-in depth, which in the fitted state lies on the lower face of the shelf bottom.

In the following, reference is also made to a modified exemplary embodiment on the basis of FIGS. 9 to 11.

In the case of the exemplary embodiment according to FIGS. 8 to 10, the anchoring opening 29 in the anchoring lug 27' preferably does not consist of a circular opening, but rather of a rectangular opening 29. Furthermore, as a result of the force reversing mechanism 22 the ball is also advanced and impinged with pressure towards the anchoring lug (while the grub screw is being tightened), wherein, however, the advancing ball 20 does not penetrate into the anchoring opening 29, but with the outer circumference of the ball lies adjacent to the anchoring opening 29 and is kept pressed against the upper transverse hoop 31' of the material section 31 surrounding the anchoring opening 29.

However, in the case of this exemplary embodiment, in order to ensure not only non-positive connection, but also positive connection, a projection 51 is provided on the opposite side of the ball 20 on the inner wall of the holding space 17', which in the fixed position engages into the anchoring opening 29, so that when the grub screw is tightened and the ball is impinged with pressure, a shelf board likewise cannot be lifted off the shelf bottom support 3.

However, in order to be able to insert the lug of a shelf bottom support into the corresponding holding space 17' of the anchoring pot, the holding space is expanded so as to diverge away from the insertion side, at least on the side in which the force reversing mechanism 22 with the ball 20 is also located. To introduce the anchoring lug 27', this must be introduced in the tilted position approximately in a parallel position or in contact with one boundary wall 17*a* until the anchoring opening 29 lies level with the projection 51. Then, the shelf bottom support 3 can be tilted in such a way that the projection 51 penetrates into the anchoring opening 29, in which the lug is moved away from the conical boundary wall 17*a*, which is aligned at an angle to the axial direction of the anchoring pot. Afterwards, the grub screw can be twisted into the fixed position, wherein in turn the ball 20 is then moved towards the lug to the extent described in order to keep this pressed in its final fixed position against the opposite boundary wall 17*a*' of the holding space 17', wherein in this condition, as shown in FIG. 11, the anchoring lug 27, 27' is then firmly secured.

In the following, a modified exemplary embodiment in accordance with FIGS. 12*a* to 14 is discussed in detail, wherein in place of a force reversing mechanism, for example in the form of a ball 20, the grub screw 21 interacts directly with the lug 27 of the shelf 3. In discussing the following exemplary embodiment, the same reference symbols describe same or comparable elements as they have been described on the basis of the preceding exemplary embodiments with reference to FIGS. 1 to 11.

In the case of the exemplary embodiment in accordance with FIG. 12*a* ff., for example, an anchoring opening 29 is used in the anchoring lug 27', which by contrast is rectangular. However, deviating therefrom in this exemplary embodiment, it can also have any arbitrary shape, being round for example.

Furthermore, a fixing screw 21, preferably a grub screw 21, can be provided in the anchoring pot 13, which can be twisted in and out of a diagonally running screw or adjustment path 23 in the material of the anchoring pot 13. This screw or adjustment path 23 is formed by a diagonally running hole or corresponding channel 24 in the material of the anchoring pot 13.

The screw or adjustment path 23 is arranged in such a way that the access opening 23' of the screw or adjustment path 23 lies on the pot lower face 13*b* laterally offset to the opening slot 17. On the other hand, the screw or adjustment path 23 is aligned diagonally so that it cuts the holding space 17'.

If now in the case of this exemplary embodiment, the shelf bottom 1 is positioned after it has been placed onto the shelf supports 3 with the anchoring pots 13 mounted therein the grub screw 21 can be twisted after the anchoring lug 27' has penetrated into the corresponding holding space in the anchoring pots 13.

As is evident in particular from the cross sectional illustration in FIG. 14, the advancing screw face 21*a* in this case moves towards the anchoring lug 27', with which it collides. As a result, after corresponding tightening a non-positive connection can be formed in such a way that now the shelf bottom can no longer be lifted upwards from the shelf bottom support, since the grub screw will not allow this.

In the exemplary embodiment shown, however, in comparison to this an improved non-positive and positive connection is formed, wherein the advancing section 21*a* of the locking or grub screw 21 at least partly intersperses the anchoring opening 29 or penetrates into it and collides with the upper transverse hoop 31' of the material section 31 surrounding the anchoring opening 29.

If an attempt were made to lift the shelf bottom upwards, as a result the anchoring pot 13 with the grub screw 21 would also be raised up, which, however, would collide with the transverse hoop 31*a* and therefore with the anchoring lug 27', which is part of the shelf bottom support.

Also, in this exemplary embodiment the anchoring opening 29 does not need to intersperse the anchoring lug 27' completely. Also, in this exemplary embodiment a recess, in which the advancing section 21*a* of the locking screw 21 can engage, would be sufficient in many cases.

The angle between the screw or adjustment path 23 for the grub screw 21 and the line vertical to the face of the shelf bottom may differ within a wide range, for example it can lie between 20° and 70°, preferably 30° and 45°.

The invention claimed is:

1. A shelf system with at least one shelf bottom support, which can be anchored in a shelf rail, so that it projects transversely away from this, wherein a shelf bottom can be laid on the at least one shelf bottom support and detachably fixed to the shelf bottom support, comprising:

an anchoring cap provided on the shelf bottom support, which can be inserted into a corresponding bore, facing the shelf bottom support, of a shelf bottom in a fixed and preferably captive manner, said anchoring cap having a lower face, the anchoring cap has an opening facing the shelf bottom support when lying on the cap lower face, a holding space located behind the opening, an access opening, provided in the anchoring cap laterally offset to opening, below which a screw path is formed in the anchoring cap, a locking screw that can be twisted in the screw path in the tightening and loosening direction, at least one anchoring projection provided on the shelf bottom support facing the shelf bottom, for attaching the shelf bottom to the shelf bottom support the anchoring projection penetrates through the opening into the holding space in the anchoring cap, the screw path of the locking screw being configured in such a way that the locking screw, adjustable therein, directly or through an intermediate force reversing mechanism and/or force transmission mechanism acts on the anchoring projection of the shelf bottom support and keeps this fixed by tightening or loosening.

2. The shelf system as claimed in claim 1, wherein the anchoring projection is configured in the form of an anchoring lug or anchoring tongue.

3. The shelf system as claimed in claim 2, wherein an anchoring recess or anchoring opening interspersing the anchoring lug is provided on the anchoring lug at least on one side.

4. The shelf system as claimed in claim 3, wherein the anchoring recess or the anchoring opening forms a shelf bottom side transverse hoop, on which the locking screw or the reversing mechanism strikes, after penetrating at least partially into the anchoring recess or anchoring opening.

5. The shelf system as claimed in claim 1, wherein a horizontal support section, preferably in the form of a support edge is provided on the shelf bottom support at the shelf bottom side adjacent to the projection, which rises above another shelf bottom side edge of the shelf bottom support and rests on the cap lower face of the anchoring cap and/or on the shelf bottom lower face.

6. The shelf system as claimed in claim 1, wherein the anchoring cap is implemented as solid material or as a chamber system, which has an opening on its cap lower face, which is preferably arranged centrically, and laterally offset thereto, an access opening being provided for manipulating the locking screw.

7. The shelf system as claimed in claim 6, wherein the opening is formed as a slot and changes into a preferably slot-type holding space located thereunder, wherein the cross sectional dimension of the opening slot and preferably the holding space located thereunder is adapted to the cross sectional dimension of the anchoring projection, preferably configured in the form of an anchoring lug.

8. The shelf system as claimed in claim 1, wherein the height and thus the length of the anchoring projection corresponds at least approximately to the axial height of the anchoring cap.

9. The shelf system as claimed in claim 1, wherein the anchoring cap is made of metal, preferably a die-cast metal such as in particular die-cast aluminum, die-cast zinc, or is made of plastic.

10. The shelf system as claimed in claim 1, wherein a projection protruding into the holding space is provided in the anchoring cap, which in the fixed condition penetrates into the anchoring recess or opening.

11. The shelf system as claimed in claim 10, wherein the holding space has diverging walls, extending from the insertion slot, in such a manner that the distance from the projection protruding into the holding space to the opposite-lying wall, limiting the holding space, corresponds to, or is greater than, the thickness of the anchoring projection or the anchoring lug.

12. The shelf system as claimed in claim 1, wherein the screw path of the locking screw leads to the force reversing mechanism, in such way that when the locking screw is adjusted in the tightening direction, this with its advancing screw section acts on the force reversing mechanism producing the transverse forces, by means of which the force reversing mechanism acts on the anchoring projection, protruding into the anchoring cap, of the shelf bottom support and keeps this fixed in a non-positive or positive fashion.

13. The shelf system as claimed in claim 1, wherein the force reversing mechanism consists of a roller or ball element which, when the tightening movement of the locking screw is increased, is held by non-positive contact on the anchoring projection of the shelf bottom support.

14. The shelf system as claimed in claim 13, wherein the force reversing mechanism, preferably in the form of a roller or ball element is guided in an adjustment path, which preferably terminates at the outer periphery of the anchoring cap.

15. The shelf system as claimed in claim 14, wherein the adjustment path is sealed by a plug on the outer periphery of the anchoring cap.

16. The shelf system as claimed in claim 15, wherein the plug is axially dimensioned or its inside has a projection in such length that the roller or ball element can only be positioned in the adjustment path, so that the roller or ball element is impinged with pressure by the axial section, related to its rotating or mid-point, of the locking screw only on the side, opposite the anchoring projection, of the roller or ball element.

17. The shelf system as claimed in claim 13, wherein the diameter of the roller or ball element is less than the width of the holding space and/or the diameter of the screw path.

18. The shelf system as claimed in claim 13, wherein the roller or ball element is held captively in the adjustment path.

19. The shelf system as claimed in claim 3, wherein the anchoring recess or anchoring opening has a minimum width or diameter, which is less than the diameter of the roller or ball element.

20. The shelf system as claimed in claim 19, wherein the roller or ball element only penetrates with a partial depth of its diameter into the anchoring recess or anchoring opening in the fixed condition.

21. The shelf system as claimed in claim 1, wherein the screw path of the locking screw cuts the holding space in such a manner that when the locking screw is adjusted in the tightening direction, the latter with its advancing screw section collides with the anchoring projection, protruding into the anchoring cap, of the shelf bottom support and/or prevents the anchoring projection from lifting off.

* * * * *